US006293812B1

(12) United States Patent
Ewer et al.

(10) Patent No.: US 6,293,812 B1
(45) Date of Patent: Sep. 25, 2001

(54) ELECTRICAL CONNECTOR CONTACT BRIDGE WITH WIRE CLAMP

(75) Inventors: Stephen R. Ewer, Milford; Jerry M. Presson, Trumbull, both of CT (US); Mark S. Bicks, Springfield, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/593,299

(22) Filed: Jun. 13, 2000

(51) Int. Cl.[7] ..... H01R 13/648

(52) U.S. Cl. ..... 439/107; 439/801; 439/781; 439/782; 174/51; 174/57

(58) Field of Search ..... 439/107, 801, 439/781, 782

(56) References Cited

U.S. PATENT DOCUMENTS

| | | | | |
|---|---|---|---|---|
| 2,684,994 | | 7/1954 | Kwake . | |
| 3,042,094 | | 7/1962 | Liljeberg . | |
| 3,414,663 | | 12/1968 | Glader . | |
| 4,090,762 | | 5/1978 | Hoffman | 339/95 R |
| 4,312,121 | | 1/1982 | Tweed | 29/611 |
| 4,913,666 | | 4/1990 | Murphy | 439/709 |
| 4,960,964 | | 10/1990 | Schnell et al. | 174/51 |
| 5,024,606 | * | 6/1991 | Ming-Hwa | 439/578 |
| 5,491,892 | | 2/1996 | Fritz et al. | 29/857 |
| 5,519,169 | | 5/1996 | Garrett et al. | 174/35 R |
| 5,608,611 | | 3/1997 | Szudarek et al. | 361/753 |
| 5,866,844 | | 2/1999 | Osterbrock et al. | 174/51 |
| 6,109,937 | * | 8/2000 | Bonilla et al. | 439/107 |

OTHER PUBLICATIONS

Hubbell Wiring Device–Kellems 1995 Catalog, pp. G–52 and others.

Hubbell Wiring Devices & Systems—Kellems Wire Management Marine Wiring Products 2000 Catalog—Cover & p. B–16.

* cited by examiner

*Primary Examiner*—Paula Bradley
*Assistant Examiner*—Ann McCamey
(74) *Attorney, Agent, or Firm*—Mark S. Bicks; Alfred N. Goodman

(57) ABSTRACT

A contact member or bridge for an electrical connector includes a bridge strap with a base plate and an abutment member coupled to and extending from the bridge strap. The base plate extends substantially perpendicular to the bridge strap and has an internally threaded bore. An abutment member extends adjacent a side edge of the base plate, and has planar surface extending perpendicularly to and facing the base plate. A clamping plate overlies the base plate, has a substantially straight side edge adjacent the planar surface and has a through bore. A screw extends through the bore in the clamping plate and threadedly engages the threaded bore in the base plate.

14 Claims, 3 Drawing Sheets

ELECTRICAL CONNECTOR CONTACT BRIDGE WITH WIRE CLAMP

FIELD OF THE INVENTION

The present invention relates to a contact bridge for an electrical connector having a wire clamp for mechanically and electrically connecting an electrically conductive wire to the contact bridge. The bridge can be used as part of an electrical device, such as an electrical receptacle or switch.

BACKGROUND OF THE INVENTION

Electrical devices, such as outlets and switches, have contact members or bridges for connecting electrically conductive wires to the contact members of the receptacle or switch. The wires are coupled to the bridges by wire clamps. The wire clamps include screws with enlarged heads under which an exposed end of electrically wire is secured. Conventionally, three separate contact members or bridges and three separate contact members or wire clamps are provided for a load wire, a neutral wire and a ground wire.

To further enhance and limit the manner in which a wire can be coupled to a contact member or bridge, a clamping plate can be provided which overlies a base plate of the contact bridge. The configuration of that clamping plate facilitates the connection of the wire, assists the assembly of the clamping plate to the contact member or bridge and controls the manner in which the wires connected. An example of a contact bridge with a clamping plate for securing a conductor is disclosed in U.S. Pat. No. 5,866,844 to Osterbrock et al.

However, such conventional clamping plate arrangements are complicated and complex to form and difficult and cumbersome to use. Additionally, the wire clamp mechanism for controlling the manner in which the connection wire is inserted into the clamping arrangement requires a higher degree of security.

SUMMARY OF THE INVENTION

An object of the present invention is to provide a contact member or bridge for an electrical connector with a clamping plate for clamping a wire which is simple and inexpensive to manufacture and can be used effectively, simply and quickly by an inexperienced operator.

Another object of the present invention is to provide a contact member or bridge for an electrical connector having a clamping plate which limits the orientation of the conductor under the clamping plate to a single orientation.

A further object of the present invention is to provide a contact member or bridge for an electrical connector with a clamping plate which is coupled to the bridge such that it can move translationally in an axial direction, but is restrained from rotating.

The foregoing objects are basically obtained by a contact bridge for an electrical connector comprising a bridge strap, a base plate coupled to the bridge strap, a first abutment member, a clamping plate and a screw. The base plate extends substantially perpendicular to the bridge strap and has an internally threaded bore. The first abutment member extends from the bridge strap adjacent a side edge of the base plate, and has a planar first surface extending substantially perpendicularly thereto and facing the base plate. The clamping plate overlies the base plate, has a substantially straight first side edge adjacent the first planar surface, and has a through bore. The screw extends through the bore in the clamping plate and threadedly engages the threaded bore in the base plate.

By forming the contact bridge in this manner, the contact bridge can be simply and inexpensively formed and simply and quickly operated, even an inexperienced operator. The clamping plate can be designed to limit the orientation of the conducted to a single orientation. The engagement between the clamping plate and the abutment member precludes rotation of the clamping member during its use when the screw is threaded into the threaded bore to tighten the clamping plate against the conductor.

Other objects, advantages and salient features of the present invention will become apparent from the following detailed description, which, taken in conjunction with the annexed drawings, disclose a preferred embodiment of the present invention.

As used in this application, the terms "up", "down", "upwardly", "downwardly" "top", "bottom", "end", "side", "front" and "back", are intended to facilitate the description of the contact bridge. Such terms are merely illustrative of the contact bridge and are not intended to limit the contact bridge to any specific orientation.

BRIEF DESCRIPTION OF THE DRAWINGS

Referring to the drawings which form a part of this disclosure.

DETAILED DESCRIPTION OF THE INVENTION

Figure 1:
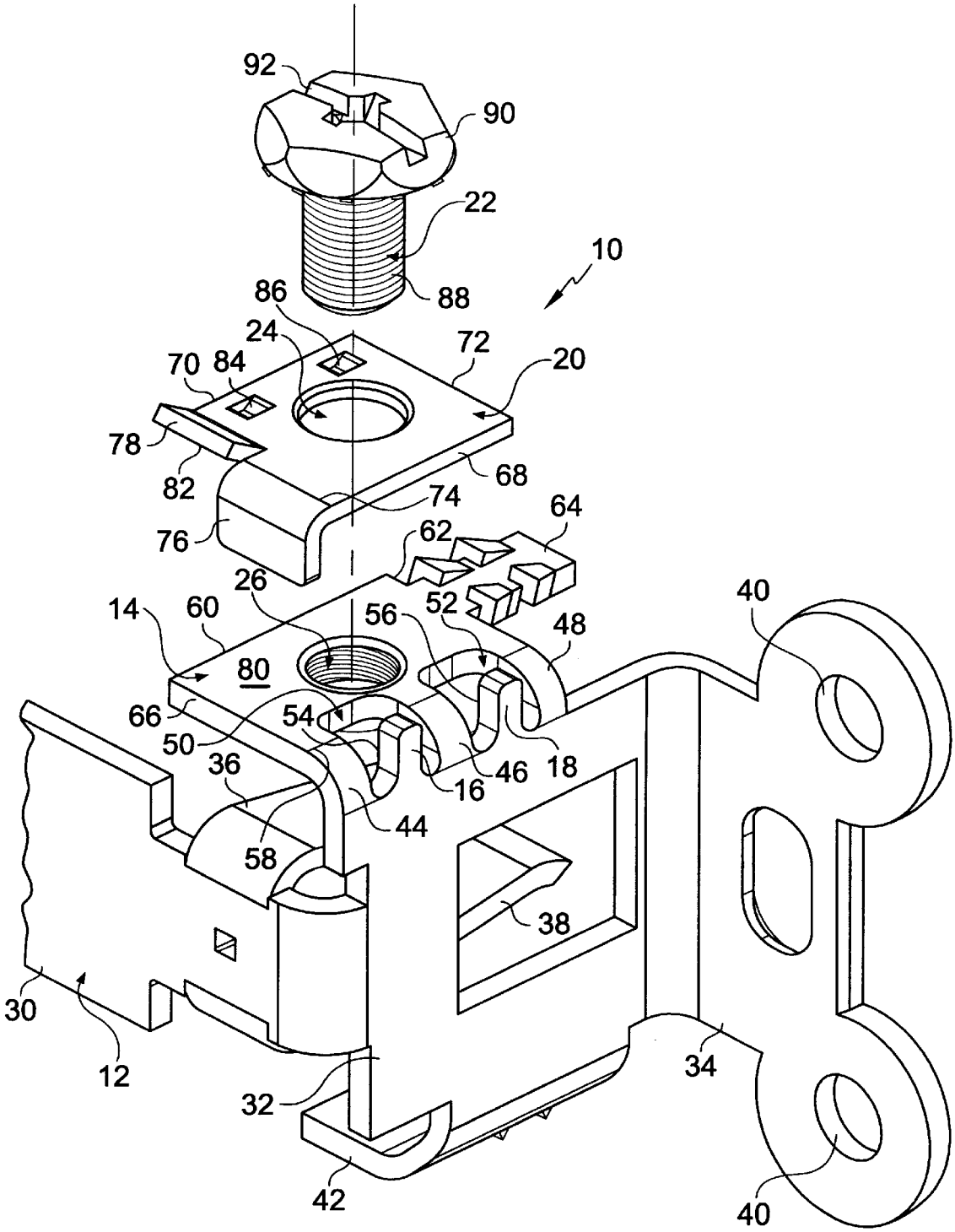
FIG. 1 is exploded, prospective view of a contact bridge according to an embodiment of the present invention.

Referring to the drawings, contact member or bridge 10 according to an embodiment of the present comprises a bridge strap 12 with a base plate 14 and abutment members 16 and 18. A clamping plate 20 overlies the base plate and engages abutment members 16 and 18. A screw 22 extends through a through bore 24 in clamping plate 20 and is threadedly engaged within a threaded bore 26 in base plate 14.

In the illustrated embodiment, the bridge strap is formed to provide the ground connection for an electrical receptacle. The grounding bridge couples ground plug contacts to a ground wire 28. However, any contact member, for such electrical devices as an outlet or a switch, can be formed in accordance with the present invention. The invention is particularly well suited for the illustrated ground connection.

Bridge strap 12 is formed from a unitary piece of conductive and resilient metal, with base plate 14 and first and second abutments 16 and 18. The bridge strap comprises a bottom member 30, an end member 32 and a top member 34. Bottom member 30 is perpendicular to end member 32. Top member 34 is perpendicular to end member 32 and substantially parallel to bottom member 30, and extends from end member 32 in a direction opposite that of bottom member 30.

In an outlet receptacle, bottom member 30 extends generally along the length of the receptacle. In a two outlet receptacle, two pairs of contact terminals are provided, only one of which is illustrated in the drawings. Each pair includes members 36 and 38 which extend from opposite sides of the bottom strap at an acute angle to the bottom strip such that the terminal members extend toward one another.

The terminal members receive a plug prong from a plug to provide connection of the plug prong and its associated conductor to the contact bridge. Typically, the terminal members extend into an insulated housing (not shown).

End member extends adjacent and end of an insulated housing of a receptacle, while top member extends laterally and outwardly from the housing. The top member is provided with bores 40 for receiving fasteners mounting the electrical receptacle in an outlet box in a conventional manner.

One side of end member 32 is provided with a coupling flange 42. Flange 42 assists in attaching the contact bridge to the receptacle housing.

Base plate 14 extends from an opposite edge of end member 32 and is connected to the end member by three bent members 44, 46 and 48. Each bent member is unitarily formed as one piece with base plate 14 and end member 32, and extends along an approximately 90 degree arc to locate base plate 14 in a position in which it is substantially perpendicular to both bottom member 30 and end member 32. The end members are spaced by openings 50 and 52 formed in the material of the bridge strap.

Abutments members 16 and 18 are coplanar extensions of end member 32 and extend unitarily as one piece from the end member. They are perpendicular to base plate 14 and are located adjacent a side edge of the base plate. The abutment members have planar surfaces 54 and 56 extending substantially perpendicular to and facing base plate 14. Abutment members 16 and 18 extend through openings 50 and 52, respectively, such that the bent members and the abutment members are aligned in an alternating array. This arrangement of the bent members, openings and the abutment members facilitates the unitary formation of the abutment members as one piece with the bridge strap.

Base plate 14 is generally rectangular in configuration having one side edge 58 coupled to bent member 44, 46 and 48. The opposite side edge 60 is a straight, free edge. End edge 62 has an attachment prong 64 extending outwardly in the same plane as the base member. Prong 64 has a plurality of barbs for securing the bridge strap to the receptacle insulated housing. The opposite end edge 66 is a straight uninterrupted free edge facing in the direction of bottom member 30 and in the direction for receiving a conductive wire.

Threaded bore 26 extends perpendicularly through the plate generally in its center portion. The dimensions of the threaded bore and the thread provided therein conform to the dimensions of a standard terminal screw 22.

Clamping plate 20 is also generally rectangular having straight, uninterrupted side edges 68 and 70 and a straight and uninterrupted back edge 72. A front, wire receiving edge 74 extends between opposite side edges 68 and 70 remote from back edge 72. Through bore 24 extends perpendicularly through clamping plate 20, and is generally evenly spaced from the end side edges.

A blocking tab 76 and a guiding tab 78 extend from the clamping plate along front edge 74 as unitary parts thereof The generally rectangular blocking tab depends from the clamping plate such that is overlies end edge 66 of base plate 14. The blocking tab extends laterally for approximately one-half the length of clamping plate front edge 74 and covers substantially half of base plate edge 66, from side edge 58 to a point aligned with the central axis of threaded bore 26.

Figure 2:
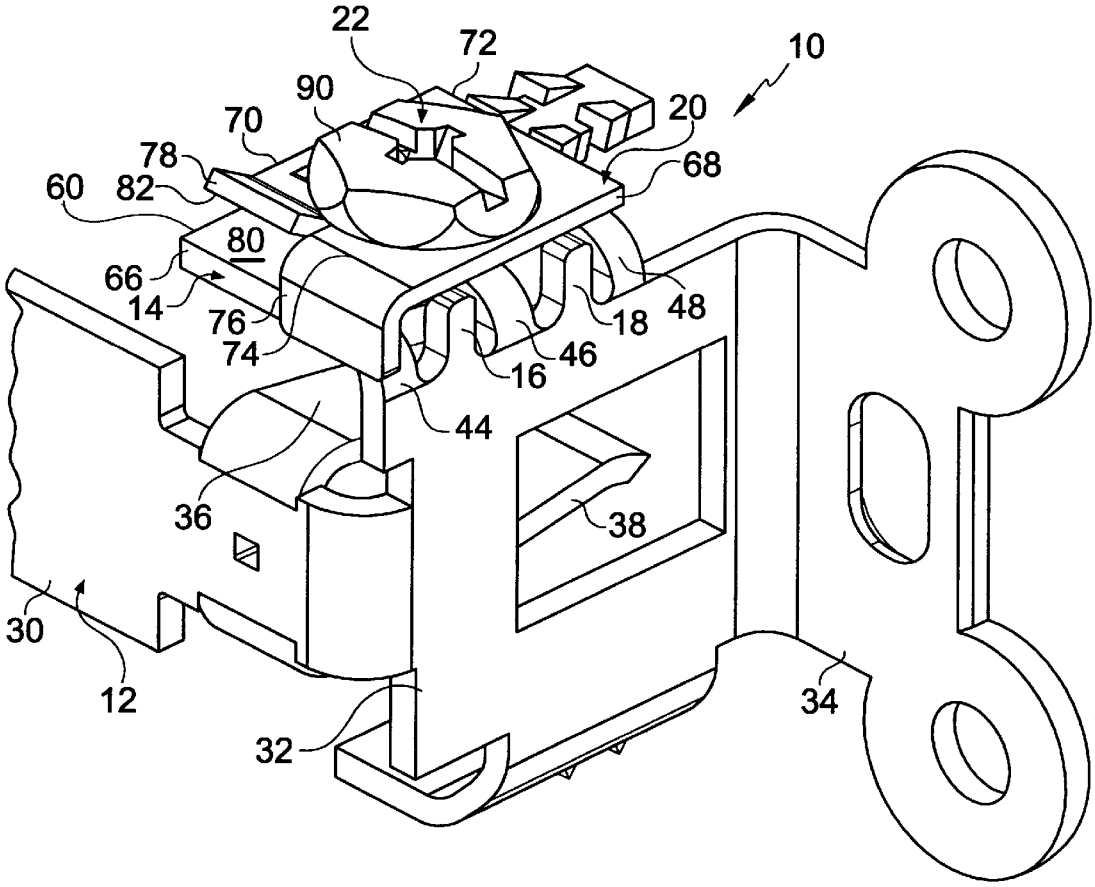
FIG. 2 is a prospective view of the assembled contact bridge of FIG. 1 in a position ready to receive a wire conductor for clamping.

With screw 22 extending through bore 24 and at least partially engaged threaded bore 26, even with clamping plate 20 spaced a distance above base plate 14, rectangular blocking tab 76 will depend a distance at least to, and preferably below, base plate upper surface 80, as illustrated in FIG. 2. This orientation of the blocking tab will greatly discourage, if not prevent, the entry of a wire between the clamping plate and the base plate past edge 66 between the center line of threaded bore 66 and abutment members 16 and 18. A conductor can only be inserted at edges 74 and 66 between the clamping plate and the base plate on the side of threaded bore 26 and through bore 24 remote from abutment members 16 and 18.

Guiding tab 78 is substantially rectangular and planar, extends at an obtuse angle upwardly and outwardly from clamping plate edge 74, and is adjacent plate blocking tab 76. In this manner, the lower surface 82 of the guiding tab forms a tapered lead end ramp to facilitate locating a conductor between the clamping plate and the base plate.

Depending barbs 84 and 86 are spaced in the clamping plate, and are adjacent to, but spaced from side edge 70 of clamping plate 20. The barbs depend from the lower surface of the clamping plate and are aligned with the guiding tab such that they will engage a conductive wire in a secure manner. Barbs 84 and 86 are unitary, one piece portions of the clamping plate and are struck from the conductive metal material of the clamping plate.

Screw 22 is a standard terminal screw having a threaded shank 88 and an enlarged head 90 at one end of the threaded shank. The head has a screwdriver slot 92, and has lateral dimensions greater than the threaded bore 26 and the through bore 24 such that the under surface of the head would overly the upper surface of the clamping plate surrounding though bore 24.

Base plate 14, clamping plate 20 and screw 22 are initially assembled as illustrated in FIG. 2 with the screw only partially threaded within bore 26. In this position, the space between the undersurface of head 90 and base plate top surface 80 is greater than the thickness of the clamping plate and barbs 84 and 86 between the end and side edges of the clamping plate. In this manner, the clamping plate can move translationally in a vertical direction, as illustrated in FIG. 2, between the base plate and the screw head, but it is prevented from rotating about the axis of the screw and bores due do the engagement of clamping plate side edge 68 with abutment members 16 and 18 and the engagement of blocking tab 64 with base plate edge 66. The engagement of side edge 68 and abutment members 16 and 18 and the engagement of blocking tab 76 and base plate edge 66 also facilitate assembly of the device by properly orienting the clamping plate and the base plate relative to one another.

Figure 3:
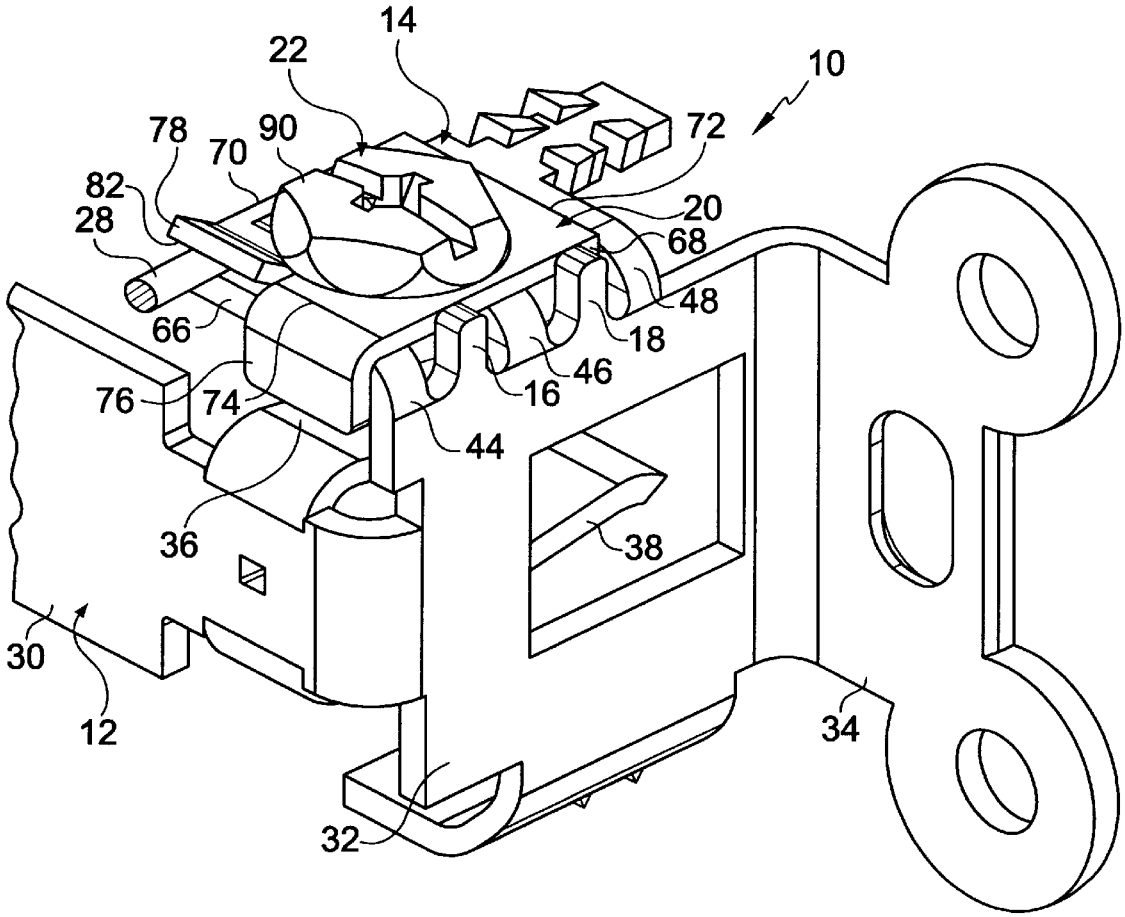
FIG. 3 is a prospective view of the assembled contact bridge of FIG. 1, with a conductive wire clamped thereto.

With the screw only partially assembled, conductive wire 28 can be inserted between the clamping plate and the base plate. The screwed is then tighten to clamp conductive wire 28 in place as illustrated in FIG. 3. The barbs will bite into the conductive wire to further enhance the connection between the wire and the contact bridge. The blocking tab permits the attachment of only a single wire to this clamping arrangement and limits that single wire to a specific orientation adjacent and parallel clamping plate edge 70 and base plate edge 60.

While a particular embodiment has been chosen to illustrate the invention, it will be understood by those skilled in the art that various changes and modifications can be made therein without departing from the scope of the invention as defined in the appended claims.

What is claimed is:

1. A contact bridge for an electrical connector, comprising:

a bridge strap;

a base plate coupled to said bridge strap and extending substantially perpendicular thereto, said base plate having an internally threaded bore;

a first abutment member extending from said bridge strap adjacent to and extending along a side edge of said base plate, and having a substantially planar first surface extending substantially perpendicularly to and facing said base plate;

a clamping plate overlying said base plate, having a substantially straight first side edge adjacent to said first planar surface, and having a through bore, said first side edge engaging said first planar surface to prevent relative rotation of said clamping plate and said base plate about an axis through said bores; and a screw extending through said through bore in said through clamping plate and threadedly engaging said threaded bore in said base plate.

2. A contact bridge according to claim 1 wherein a second abutment member extends from said bridge strap adjacent said side edge of said clamping plate, is spaced from and is parallel to said first abutment member, has a substantially planar second surface extending substantially perpendicular and facing said base plate and coplanar with said first surface, and engages said first side edge at a location spaced from engagement thereof with said first abutment member.

3. A contact bridge according to claim 2 wherein said bridge strap, said abutment members and said base plate are unitarily formed from a single piece of electrically conductive material;

a plurality of bent members couple said bridge strap to said base plate; and said bent members and said abutment members are arranged in an alternating and aligned array along said side edge of said base plate.

4. A contact bridge according to claim 1 wherein said bridge strap, said abutment member and said base plate are unitarily formed from a single piece of electrically conductive material;

a plurality of bent members couple said bridge strap to said base plate; and said bent members and said abutment member are arranged in an alternating and aligned array along said side edge of said base plate.

5. A contact bridge according to claim 1 wherein a blocking tab depends from a wire entry edge of said clamping plate and overlies an end edge of said base plate, said wire entry edge extending from and at an angle to said first side edge.

6. A contact bridge according to claim 5 wherein said blocking tab extends laterally for only a portion of said wire entry edge of said clamping plate.

7. A contact bridge according to claim 5 wherein said blocking tab extends laterally for approximately one-half a length of said wire entry edge of said clamping plate.

8. A contact bridge according to claim 6 wherein a guiding tab extends at an obtuse angle upwardly and outwardly from said clamping plate at said wire entry end and adjacent said blocking tab.

9. A contact bridge according to claim 8 wherein said guiding tab is substantially planar.

10. A contact bridge according to claim 8 wherein said clamping plate has depending barbs aligned with said guiding tab.

11. A contact bridge according to claim 1 wherein said clamping plate has depending barbs.

12. A contact bridge according to claim 1 wherein said bridge strap comprises resilient terminal members for engaging a plug prong.

13. A contact bridge according to claim 1 wherein said bridge strap forms a grounding bridge for an electrical receptacle.

14. A contact bridge for an electrical receptacle, comprising:

a bridge strap having unitary resilient terminals spaced from a bridge end portion;

a base plate unitarily formed with and coupled to said bridge end portion by unitary bent members, said base plate extending substantially perpendicular to said bridge end portion and having an internally thread bore;

first and second abutment members extending unitarily from said bridge end portion adjacent to and extending along a side edge of said base plate, said first and second abutment members having substantially planar surfaces extending substantially perpendicularly to and facing said base plate, said abutment members and said bent members being aligned in an alternating array along said side edge of said base plate;

a clamping plate overlying said base plate, having substantially straight, opposite side edges, having a wire receiving edge between said side edges, and having a through bore between and spaced from said edges of said clamping plate, one of said side edges engaging said planar surfaces to prevent rotation of said clamping plate relative to said base plate about an axis through said bores;

a blocking tab depending from said clamping plate at said wire entry edge and overlying an end edge of said base plate, said wire entry edge extending form said one of said side edges, said blocking tab extending laterally from said one of said side edges for approximately one-half a length of said wire entry edge;

a substantially planar guiding tab extending at an obtuse angle upwardly and outwardly from said clamping plate at said wire entry edge and adjacent said blocking tab; and a screw extending through said through bore in said clamping plate and threadedly engaging said threaded bore in said base plate.

* * * * *